US007503766B2

(12) United States Patent
Havermann

(10) Patent No.: US 7,503,766 B2
(45) Date of Patent: Mar. 17, 2009

(54) BLOCKING DEVICE FOR PREVENTING BOARD CONNECTOR MISMATING

(75) Inventor: Gert Havermann, Wallenhorst (DE)

(73) Assignee: HARTING Electronics GmbH & Co. KG, Espelkamp (DE)

( * ) Notice: Subject to any disclaimer, the term of this patent is extended or adjusted under 35 U.S.C. 154(b) by 0 days.

(21) Appl. No.: 11/945,863

(22) Filed: Nov. 27, 2007

(65) Prior Publication Data

US 2008/0139010 A1 Jun. 12, 2008

(30) Foreign Application Priority Data

Dec. 8, 2006 (DE) ..... 20 2006 018 590 U

(51) Int. Cl.
*H01R 12/00* (2006.01)

(52) U.S. Cl. ..... 439/65; 439/594; 439/717; 439/680; 439/631

(58) Field of Classification Search ..... 439/594, 439/717, 680, 660, 631, 65
See application file for complete search history.

(56) References Cited

U.S. PATENT DOCUMENTS

| | | | | |
|---|---|---|---|---|
| 4,046,452 | A * | 9/1977 | Cassarly | 439/594 |
| 5,014,163 | A * | 5/1991 | Lin | 361/796 |
| 2002/0142660 | A1* | 10/2002 | Abe | 439/631 |
| 2007/0099514 | A1* | 5/2007 | Ito | 439/660 |

* cited by examiner

*Primary Examiner*—Tho D Ta
(74) *Attorney, Agent, or Firm*—Hayes Soloway P.C.

(57) ABSTRACT

In order to prevent the mismating of several daughterboards (2) that are combined into a plug-in unit (20) with corresponding board connectors (3) on a motherboard (1), it is proposed that the mating of the plug-in unit (20) is effectively prevented by means of a blocking block (10) that is inserted into an intermediate space between two board connectors (3) that are spaced apart from one another by a regular connector spacing and snapped into window-like recesses (4) of the board connectors (3).

6 Claims, 5 Drawing Sheets

BLOCKING DEVICE FOR PREVENTING BOARD CONNECTOR MISMATING

BACKGROUND OF THE INVENTION

1. Field of the Invention

The invention pertains to a blocking device for preventing the mismating of daughterboards on a motherboard, particularly when several daughterboards are combined into a plug-in unit and at least two board connectors contact the motherboard.

A device of this type is required for preventing one or more daughterboards that are combined into a plug-in unit from being mated with a motherboard fitted with a large number of identical board connectors in regions of the motherboard which are not intended for this configuration and possibly causing system failures.

2. Description of the Related Art

Two different types of modular connectors can be mated with comprehensive backplane systems—i.e., large motherboards—that are fitted with identical board connectors assigned to a MicroTCA-system. One system is known under the name "Advanced Mezzanine Card" (AMCs) while another system is known as "Mezzanine with Auxiliary Connections" (Multitongue-AMCs) that also accommodates Micro-TCA-Carrier-Hub-Modules (MCHs).

The Multitongue-AMC-Modules are edge connectors with attached circuit boards, on which such a large number of signaling contacts is provided on the circuit card that at least two separate mating areas are required on the motherboard for the transmission of the signals.

Furthermore, if two daughterboards are combined, it may be necessary to provide three or four mating areas that transmit their signals to the backplane via an identical number of board connectors.

In this case, the combined daughterboards may be directly connected via their strip conductor ends in the form of edge connectors or mated with the board connectors on the motherboard by means of a so-called multi-board connector attachment.

This multi-board connector attachment is manufactured separately, connected to the circuit boards and contacts the board connectors on the backplane.

Since the board connectors for the AMCs and the Multitongue-AMCs on the motherboard are identical but have different contact configurations, it needs to be ensured that mismating or the mating in impermissible board connector areas is prevented.

SUMMARY OF THE INVENTION

The invention therefore is based on the objective of preventing a plug-in unit consisting of several daughterboards from being mated in regions on the motherboard which are not intended for this plug-in unit.

This objective is attained in that a blocking block is inserted between two board connectors arranged within a regular connector spacing, in that snap-in tabs are provided on the blocking block, and in that the longitudinal sides of the board connectors feature window-like recesses, into which the snap-in tabs of the blocking block engage, wherein the blocking block prevents the mating of the plug-in unit in the form of combined daughterboards on the motherboard.

Two contacting options, in principle, are available for realizing the transmission of a large quantity of signals from one or more plug-type daughterboards to a motherboard, namely the direct mating between the strip conductor ends of the daughterboard with a board connector on the motherboard and the mating by means of an additional connector that is rigidly connected to the daughterboard and then mated with the board connector.

Once the number of signaling contacts that are arranged adjacent to one another or on top of one another in sandwich cards no longer suffices for realizing the transmission via one connector, one utilizes an interconnection of several staggered connectors that is also referred to as a multi-board connector attachment in this context.

Since identical board connectors on larger motherboards also have different contact configurations in many applications, it is possible that mismated daughterboards lead to complete system failures.

In order to block such mating areas, it is proposed to insert a blocking element that prevents the mismating of the plug-in daughterboard unit into the intermediate spaces of the regular connector spacing between the board connectors.

To this end, the longitudinal sides of the board connectors on the backplane or motherboard are preferably provided with window-like recesses that are formed by longitudinal ribs and intersecting cross-ribs.

Furthermore, the blocking elements advantageously feature flexible snap-in tabs that engage on the longitudinal ribs during the insertion between two board connectors and thusly prevent the mating of the plug-in unit.

In this case, the coding blocks could be provided in two different sizes that can also be inserted between board connectors that are spaced apart from one another by different distances.

BRIEF DESCRIPTION OF THE DRAWINGS

One embodiment of the invention is illustrated in the figures and described in greater detail below. The figures show:

FIG. 3 a top view of several board connectors with blocking blocks arranged in between;

DESCRIPTION OF THE PREFERRED EMBODYMENTS

Figure 1:
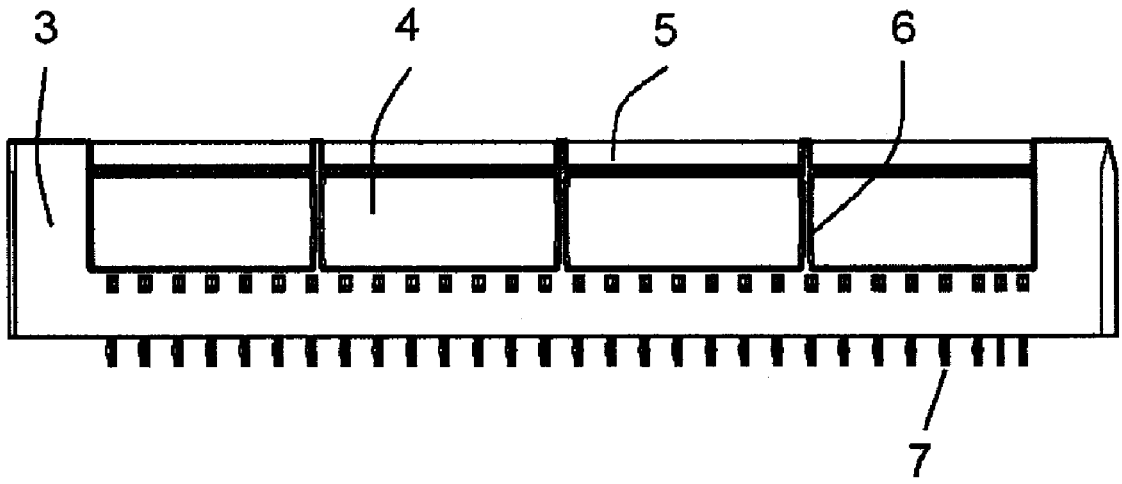
FIG. 1 a board connector.

FIG. 1 shows a side view of one longitudinal side of a board connector 3 which features four window-like recesses 4 in this case.

The window-like recesses 4 are realized in the form of depressions formed by several vertically extending cross-ribs 6 and intersecting, horizontally extending longitudinal ribs 5.

Figure 2A:
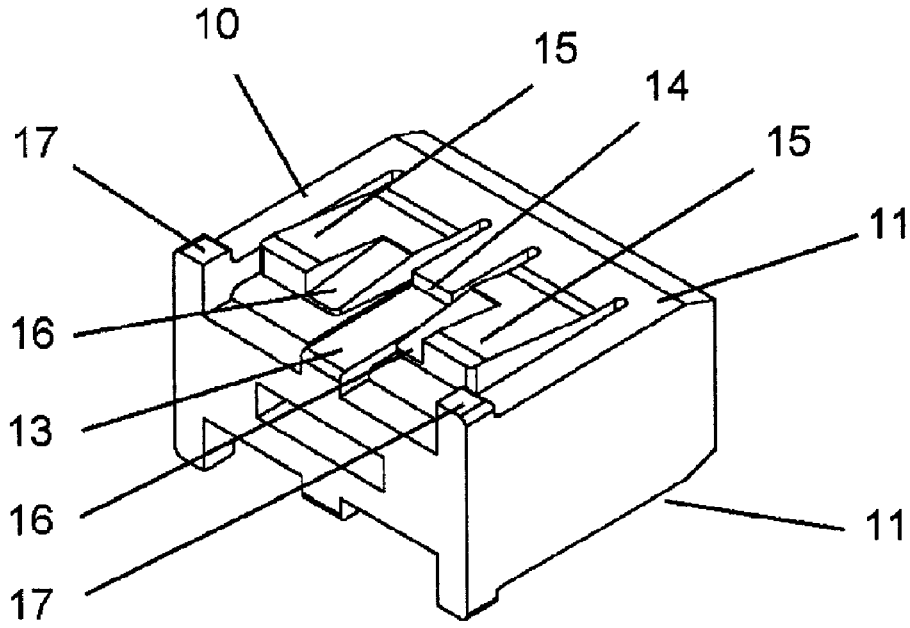
FIG. 2*a* an isometric representation of the blocking block.
Figure 2B:
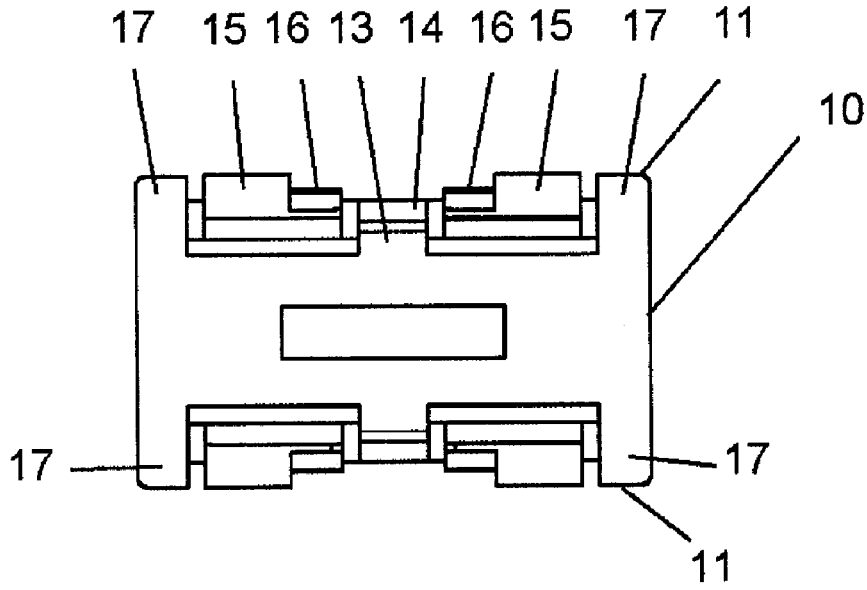
FIG. 2*b* a top view of the blocking block.

FIGS. 2*a*, 2*b* show an inventive blocking block. In this case, FIG. 2*a* shows an isometric representation and FIG. 2*b* shows a top view of the blocking block.

The blocking block 10 essentially has a cuboid shape and is realized in the form of a hollow body. Two outwardly protruding snap-in tabs 15 that are exposed on three sides and separated by a central brace 13 are respectively realized to both sides of its longitudinal sides 11.

In addition, a partially wedge-shaped recess 16 is provided on each of the snap-in tabs 15 to both sides of the central brace 13.

In this region, the central brace 13 is recessed relative to the remainder of the longitudinal side 11 by a step 14.

Figure 3:
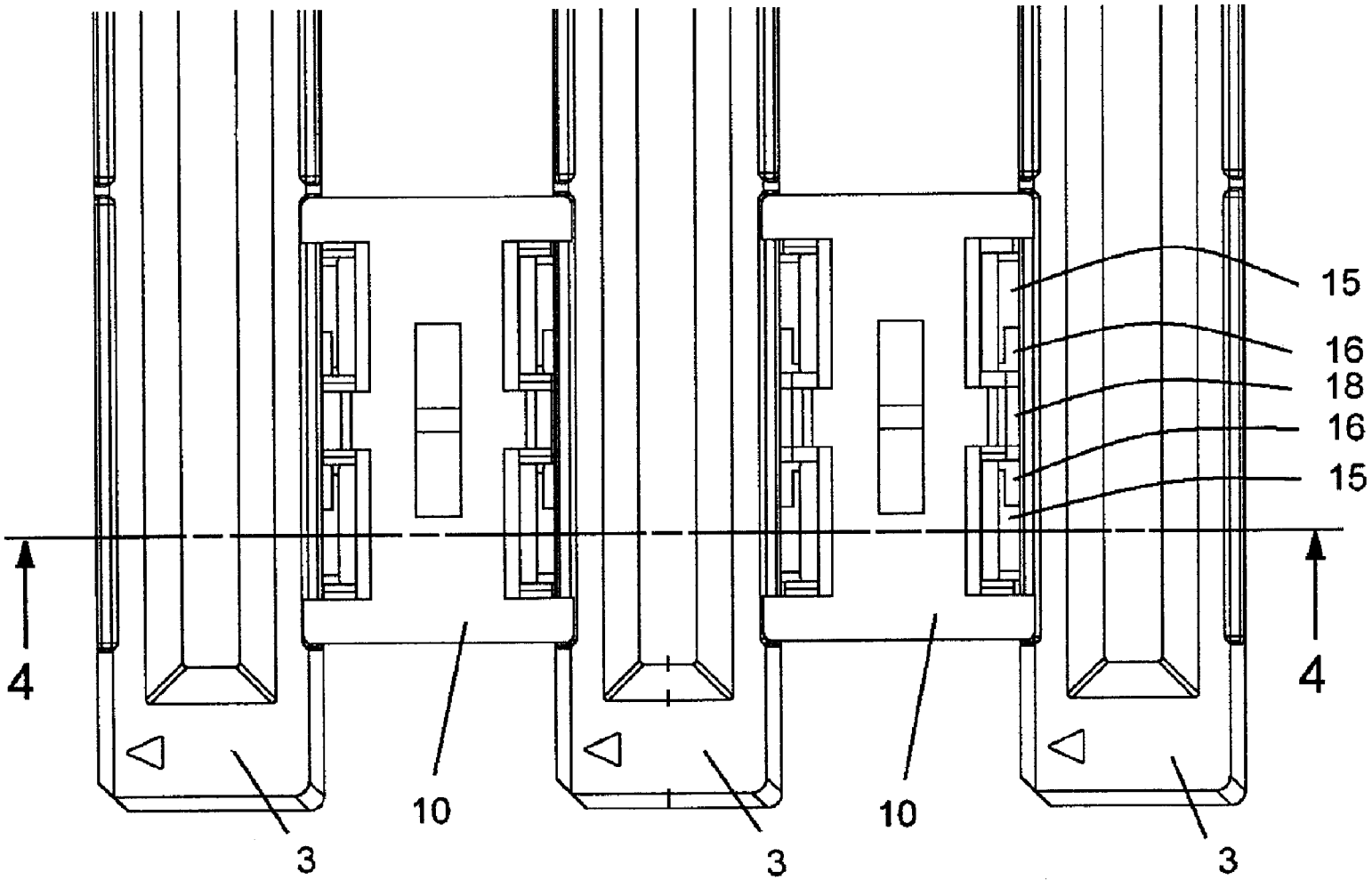

In addition, projections 17 are integrally formed onto the four corner sides and remain positioned above the horizontally extending longitudinal ribs 5 during the insertion of a blocking block between two board connectors 3 while the snap-in tabs 15 engage into one of the window-like recesses 4 underneath the longitudinal ribs 5 (in this context, see also FIG. 3).

In order to remove an engaged blocking block, part of the two snap-in tabs 15 that adjoin the central brace 13 is recessed in a wedge-shaped fashion. Since the central brace 13 is recessed at this location, a slot 18 is formed into which a corresponding tools such as, e.g., the point of a screwdriver can be inserted up to the step 14 in order to respectively bend back two adjacent snap-in tabs 15 and subsequently remove the blocking block.

FIG. 3 shows a top view of several board connectors 3 that are arranged parallel to one another and between which a blocking block 10 was respectively inserted. In this case, it is essentially unimportant into which of the four possible window-like recesses a blocking block 10 is inserted in order to prevent the mismating of a certain version of plug-in board.

Figure 4:
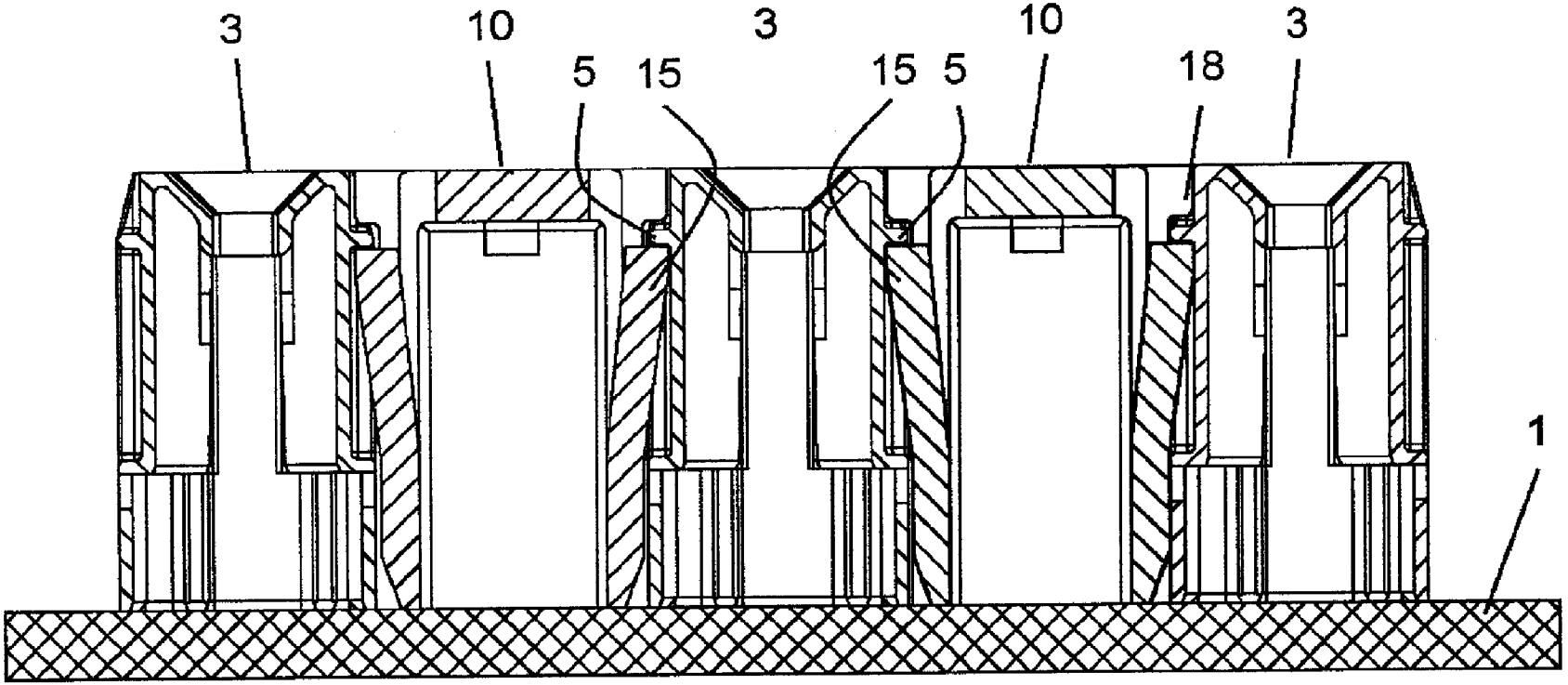
FIG. 4 a section through FIG. 3.

FIG. 4 shows a section through several board connectors 3 according to FIG. 3 that are arranged adjacent to one another on a motherboard 1 and correspondingly spaced apart from one another, wherein blocking blocks 10 are inserted between the connectors.

One can clearly ascertain how the ends of the snap-in tabs 15 are engaged on the horizontally extending longitudinal ribs 5.

This makes it clear how an inserted blocking block 10 effectively prevents the mating of a plug-in unit 20 that comprises several daughterboards.

In this case, the daughterboards 2 may be realized in the form of an edge connector in order to be directly mated or combined into a multi-board connector attachment 22.

In this case, an individual daughterboard naturally can also be easily mated.

Figure 5:
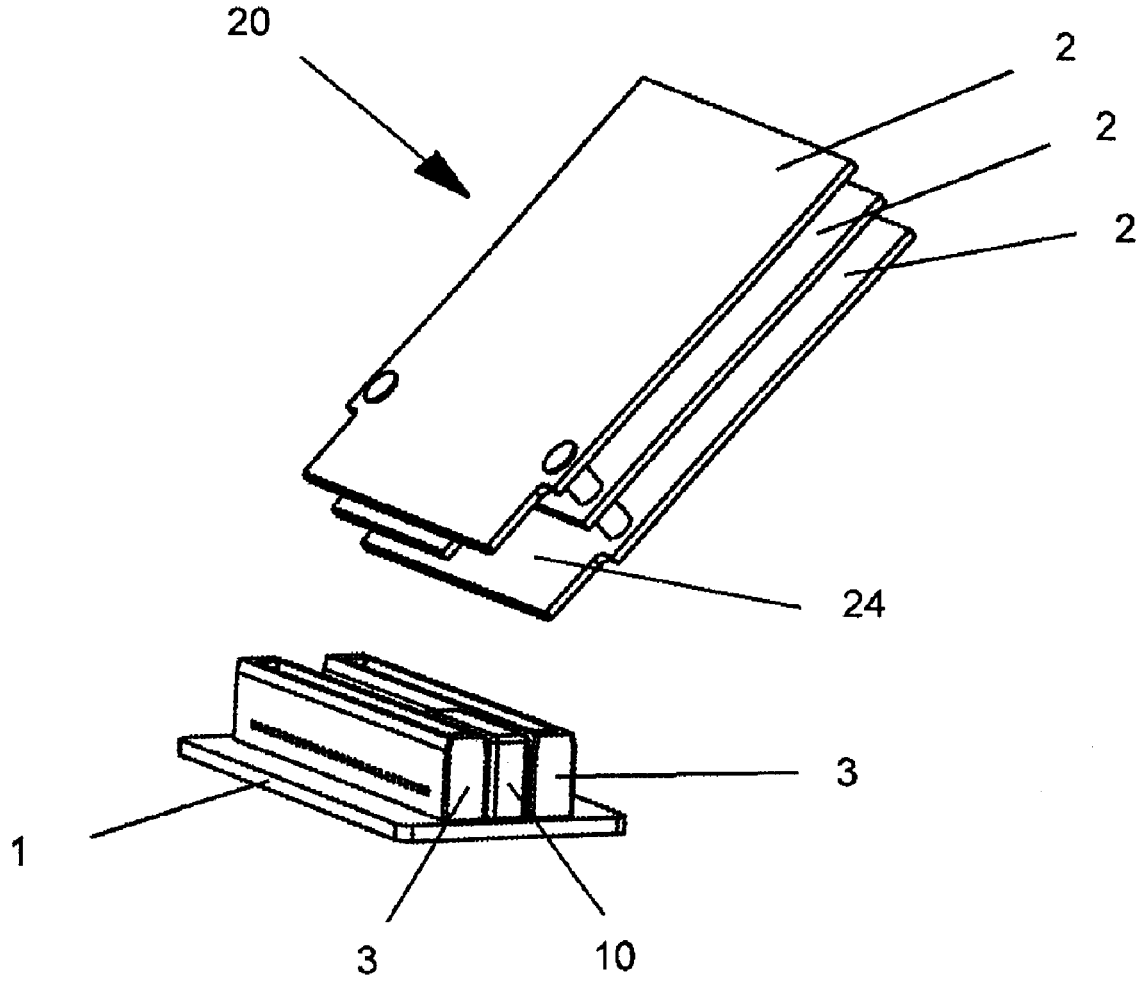
FIG. 5 the coding of a plug-in unit by means of the blocking block.

However, the windows 4 realized in the board connectors 3 and at least one blocking block 10 also make it possible to realize the coding of a plug-in unit 20 shown in FIG. 5.

In this case, the plug-in unit 20 shown consists of three combined daughterboards 2 that are designed for being directly mated with the board connectors 3, wherein the central daughterboard features a recess 24.

The schematically illustrated motherboard 1 features two board connectors 3 and a blocking block 10 snapped in between the board connectors.

This plug-in unit can be easily mated because the blocking block 10 exactly fits into the recess 24 of the central daughterboard. In this plug-in unit, it is ensured that the central daughterboard transmits its signals via the two adjacent boards.

Consequently, only this plug-in unit can be mated—despite the actual blocking function of the blocking block that would be fulfilled if the central daughterboard would not feature a recess.

What is claimed is:

1. A device for preventing mismating of daughterboards combined into a plug-in unit with corresponding board connectors arranged with regular connection spacing on a motherboard, wherein at least three daughterboards are combined to form said plug-in unit, and at least two board connectors contact the motherboard, wherein a blocking block having snap-in tabs is inserted between two board connectors, and the longitudinal sides of the board connectors feature window-like recesses into which the snap-in tabs of the blocking block engage, and wherein the blocking block prevents mismating of the plug-in unit on the motherboard.

2. The blocking device according to claim 1, wherein the window-like recesses on the longitudinal sides of the board connectors are formed by longitudinal ribs and intersecting cross-ribs.

3. The blocking device according to claim 1, wherein regions of the snap-in tabs of the blocking block feature a wedge-shaped recess.

4. The blocking device according to claim 1, wherein a central brace with a step is provided between the snap-in tabs.

5. The blocking device according to claim 1, wherein an engaged blocking block is disengageable from the longitudinal ribs of the board connectors by means of a flat tool that is inserted into the wedge-shaped recesses of the two snap-in tabs in order to bent back the snap-in tabs.

6. The blocking device according to claim 1, wherein the blocking block is provided for coding a plug-in unit in connection with one or more recesses on the mating side of at least one of the daughterboards of the plug-in unit.

* * * * *